US008028939B2

(12) United States Patent
Nakamura et al.

(10) Patent No.: US 8,028,939 B2
(45) Date of Patent: Oct. 4, 2011

(54) METHOD FOR NICKEL CONCENTRATION PROCESSING OF SAPROLITE ORE

(75) Inventors: Iichi Nakamura, Tokyo (JP); Jun-ichi Takahashi, Niihama (JP)

(73) Assignee: Sumitomo Metal Mining Co., Ltd., Tokyo (JP)

( * ) Notice: Subject to any disclaimer, the term of this patent is extended or adjusted under 35 U.S.C. 154(b) by 239 days.

(21) Appl. No.: 12/473,441

(22) Filed: May 28, 2009

(65) Prior Publication Data

US 2010/0065478 A1 Mar. 18, 2010

(30) Foreign Application Priority Data

Sep. 18, 2008 (JP) ..... 2008-238904

(51) Int. Cl.
*B02C 19/00* (2006.01)

(52) U.S. Cl. ..... 241/24.1; 241/25; 241/29

(58) Field of Classification Search ..... 241/29, 241/20, 24.1, 21, 25
See application file for complete search history.

(56) References Cited

U.S. PATENT DOCUMENTS

| | | | |
|---|---|---|---|
| 2,175,484 | A | 10/1939 | Rees et al. |
| 4,362,558 | A | 12/1982 | Desnoes et al. |
| 6,053,327 | A | 4/2000 | Cardini et al. |

FOREIGN PATENT DOCUMENTS

| | | |
|---|---|---|
| GB | 2032896 | 5/1980 |
| JP | 52-23504 | 2/1977 |
| JP | 3-4610 | 1/1991 |
| JP | 11-117030 | 4/1999 |
| JP | 11-124640 | 5/1999 |
| WO | WO-2005005671 A1 | 1/2005 |

OTHER PUBLICATIONS

Supplementary European Search Report for European Patent Application No. 09814358.9 issued Nov. 2, 2010.

"Lecture summary of research result presentation by the Mining Institute of Japan", 1987, pp. 365 to 366.

J. K. Mohanty, "Mineralogy and pre-concentration of the chromite overburden of the Sukinda Ultramafic Belt, Orissa, India," CIM Bull, (Canada), vol. 93, No. 1038, 2000, pp. 37 to 43.

*Primary Examiner* — Mark Rosenbaum

(74) *Attorney, Agent, or Firm* — Edwards Angell Palmer & Dodge LLP

(57) ABSTRACT

The method for nickel concentration processing, which is low cost, simple and convenient, as well as having low environmental load, which is capable of enhancing nickel content of a saprolite ore with low nickel content, which was not conventionally used effectively as a raw material of ferronickel smelting due to having low nickel content, to a level to be utilized economically as a raw material of ferronickel smelting.

14 Claims, 5 Drawing Sheets

(a)

(b)

METHOD FOR NICKEL CONCENTRATION PROCESSING OF SAPROLITE ORE

BACKGROUND OF THE INVENTION

1. Field of the Invention

The present invention relates to a method for nickel concentration processing of a saprolite ore, for more detail, to a method for nickel concentration processing from a low grade saprolite ore which is not used for ferronickel smelting process, with low cost, simple and convenient, as well as having low environmental load. By using this method, resource amount of a nickel ore, now approaching to a nearly depleted state, can be increased, transportation cost and smelting cost can be reduced, and still more prevention of environmental problems can be attained.

2. Description of the Prior Art

In general, a raw material ore for nickel smelting is largely classified to a sulfide ore and an oxide ore such as a laterite ore. And in addition, the laterite ore is classified to a saprolite ore and limonite ore. The saprolite ore has a relatively high nickel content of equal to or higher than 2% by mass, containing magnesia, silica, iron and the like as main composition components, and composed of ores such as a water-containing silicic bittern ore, goethite. The limonite ore present at the upper part thereof, having a low nickel content of about 1.5% by mass, and composed of goethite as a main ore.

The above saprolite ore has been used from old times, as a practical raw material ore to produce ferronickel, however, the saprolite with high nickel content has been depleted, and nickel content of a raw material ore to be utilized in ferronickel smelting has been decreased, which has raised a large problem in view of economical production.

That is, in ferronickel smelting, usually, a saprolite ore containing a large quantity of moisture is subjected to roasting at a high temperature of up to about 900° C., in order to decrease an attached moisture content and a crystal moisture content to a predetermined level, and then the resulting calcinated ore is subjected to reductive dissolution in a melting furnace such as an electric furnace at a temperature of about 1500° C., so as to produce ferronickel with predetermined nickel content satisfying a product standard. Therefore, decrease in nickel content of a raw material ore not only increases consumption amount of energy such as electricity, heavy oil, and increases smelting cost extremely, but also could decrease the resulting nickel content of ferronickel produced in the electric furnace, to a level below the product standard required on the market, although it depends on a containing state of iron present together. Therefore, it also contains an environmental problem.

Furthermore, special steel based mainly on stainless steel occupies a large portion of nickel consumption, therefore it is important to secure amount of ferronickel, and stable supply of a saprolite ore with high nickel content now depleting at present, can be said an urgent problem. Incidentally, a wet-type smelting method such as a sulfuric acid leaching method of a laterite ore, which has been progressing recently, is generally suitable to a limonite ore with low magnesium content, however, on the contrary, it is not necessarily suitable to a saprolite ore with high magnesium content, in view of high acid consumption etc. In addition, a saprolite ore imported from a mine is usually in a state of having a high moisture content of equal to or higher than 30% by mass, and also a low nickel content of 2 to 2.6% by mass, therefore cost of a raw material ore including transportation cost was increased to a very high level.

Therefore, there has been required conventionally to enhance nickel content of such a laterite ore, and for example, trials have been made to attain the increase in content by application of a beneficiation method such as flotation, magnetic separation (for example, refer to Non-Patent Literature 1, 2). However, these methods have many problems in view of difference in result by each of a target ore, or processing cost, and thus practical application has not yet been achieved.

Under these circumstances, there has been disclosed a method for classification performing of a raw material saprolite ore, and still more specific gravity separation by each of the classified portions (for example, refer to Patent Literature 1, 2, 3, 4). However, these methods are wet-type methods, and provide ores with very poor precipitation property and dehydration property, therefore require a large quantity of thickener and a dehydration machine as a facility therefor, and not only increases cost extremely but also requires many labor in environmental preservation such as exhaust water processing, management of a tailing dam. Therefore, a method for concentration of slime using an organic flocculant has also been proposed (refer to Patent Literature 5), however, it requires a large quantity of the flocculant and thus has not led to cost reduction. Still more, since high water content of a raw material is equal to or higher than 30% by mass, in order to reduce transportation cost and smelting cost, drying of an ore at a mine site was tried, however, it has found to create a new problem of nickel amount loss and deterioration of workability, caused by scattering in handling such as loading and unloading or the like, because the ore has very strong powder dust property in the case of low water content, and thus practical application is in a difficult state.

Under such a state, it has been required a method for nickel concentration processing, which is low cost, simple and convenient, as well as having low environmental load, which is thus capable of enhancing nickel content of a saprolite ore with low nickel content, to a level to be utilized economically as a raw material of ferronickel smelting.

Patent Literature 1: U.S. Pat. No. 6,053,327
Patent Literature 2: JP-A-52-023504 (page 1)
Patent Literature 3: JP-B-03-004610 (page 1)
Patent Literature 4: JP-A-11-117030 (page 1, page 2)
Patent Literature 5: JP-A-11-124640 (page 1, page 2)
Non-Patent Literature 1: "Lecture summary of research result presentation by The Mining Institute of Japan", 1987, pages 365 to 366
Non-Patent Literature 2: "CIM Bull", (Canada), vol. 93, No. 1038, 2000, pages 37 to 43

SUMMARY OF THE INVENTION

In view of the above conventional technological problems, it is an object of the present invention to provide a method for nickel concentration processing, which is low cost, simple and convenient, as well as having low environmental load, which is capable of enhancing nickel content of a saprolite ore with low nickel content, which was not conventionally used effectively, as a raw material of ferronickel smelting, due to having low nickel content, to a level to be utilized economically as a raw material of ferronickel smelting.

The present inventors have intensively studied a method for nickel concentration processing of a saprolite ore, to attain the above object and found that nickel content can be enhanced to a level to be utilized economically as a raw material of ferronickel smelting, by a low cost, simple and convenient method, as well as having low environmental load, by subjecting a saprolite ore having low nickel content. The process consists of a crusher, a dryer, a dry-type attrition processing, and dry-type classification processing and dry-type specific gravity separation processing. Upgraded ore can be obtained by recovering each of the obtained ore portion, having a particle size of equal to or smaller than specific classification point, and ore portion, having a specific gravity of equal to or smaller than specific value. And still more, instead of the above specific crusher, dryer and attrition processing, a stirring-type dryer or a dry-type Autogeneous mill can be applied for carrying out crushing process, drying process and attrition process at the same time.

That is, according to a first aspect of the present invention, there is provided a method for nickel concentration processing of a saprolite ore, characterized by including the steps of the following (1) to (4):

(1) a saprolite ore is subjected to crushing processing to adjust the ore particle size to a size passing a sieve with an mesh opening of 50 mm.

(2) a crushed ore obtained in the step of the above (1) is subjected to dry-type attrition processing of the surface layer part by attrition.

(3) a ground ore obtained in the step of the above (2) is subjected to dry-type classification processing at a classification point to be selected from 0.5 to 2.0 mm, and then an ore portion having a particle size of equal to or smaller than said classification point is recovered as a nickel concentrate.

(4) an ore portion having a particle size over the classification point, obtained in the step of the above (3), is subjected to dry-type specific gravity separation processing, and then an ore portion having a specific gravity of equal to or smaller than 2.0, is recovered as a nickel concentrate.

In addition, according to a second aspect of the present invention, there is provided the method for nickel concentration processing of a saprolite ore in the first aspect, characterized in that a crushed ore is subjected to a drying processing prior to the dry-type attrition processing, in the step of the above (2).

In addition, according to a third aspect of the present invention, there is provided the method for nickel concentration processing of a saprolite ore in the first or the second aspect, characterized by further including the step of the following (5).

(5) an ore portion having a particle size of equal to or smaller than the classification point, obtained in the step of the above (3), and an ore portion having a specific gravity of equal to or smaller than 2.0, obtained in the step of the above (4), are mixed to a saprolite ore for a raw material of ferronickel smelting having a free water.

In addition, according to a fourth aspect of the present invention, there is provided the method for nickel concentration processing of a saprolite ore in the first aspect, characterized by including the step of the following (1') instead of the steps of the above (1) and (2).

(1') a saprolite ore is subjected to crushing, drying and dry-type attrition processing by using a stirring-type dryer to perform crushing processing, drying processing and dry-type attrition processing at the same time, to adjust the ore particle size to a size passing a sieve with an mesh opening of 50 mm.

In addition, according to a fifth aspect of the present invention, there is provided the method for nickel concentration processing of a saprolite ore in the fourth aspect, characterized by including the steps of the following (2') to (4') subsequent to the step of the above (1').

(2') a ground ore obtained in the step of the above (1') is subjected to dry-type classification processing at a classification point to be selected from 2 to 5 mm.

(3') an ore portion having a particle size of equal to or smaller than said classification point, obtained in the step of the above (2'), is subjected to dry-type classification processing at a classification point to be selected from 0.01 to 2.0 mm, and then an ore portion, having a particle size of equal to or smaller than said classification point, is recovered as a nickel concentrate.

(4') an ore portion, having a particle size over the classification point, obtained in the step of the above (2'), is subjected to dry-type specific gravity separation processing, and then an ore portion, having a specific gravity of equal to or smaller than 2.0, is recovered as a nickel concentrate.

In addition, according to a sixth aspect of the present invention, there is provided the method for nickel concentration processing of a saprolite ore in the fifth aspect, characterized by further having the step of the following (5').

(5') an ore portion, having a particle size of equal to or smaller than the classification point, obtained in the step of the above (3'), and an ore portion, having a specific gravity of equal to or smaller than 2.0, obtained in the step of the above (4'), are mixed to a saprolite ore for a raw material of ferronickel smelting.

In addition, according to a seventh aspect of the present invention, there is provided the method for nickel concentration processing of a saprolite ore in any one of the first to the sixth aspects, characterized in that the above saprolite ore has a nickel content of 1.8 to 2.3% by mass.

The method for nickel concentration processing of a saprolite ore according to the present invention, is capable of enhancing nickel content of a saprolite ore with low nickel content, which was not conventionally used effectively as a raw material of ferronickel smelting due to having low nickel content, to a level to be utilized economically as a raw material of ferronickel smelting, by a low cost, simple and convenient method, as well as having low environmental load, therefore industrial value thereof is extremely large.

In addition, by using this method, resource amount of a nickel ore, now approaching to a nearly depleted state, can be increased, transportation cost and smelting cost can be reduced, and still more prevention of environmental problems can be attained.

Still more, by transportation of the obtained nickel concentrate, after mixing with a saprolite ore containing the free water and having high nickel content, which does not require the method for concentration processing of the present invention, there can be provided an operation form for suppressing the powder dust generation, which is a problem of a dry-type system, enhancing handling performance, and also attaining improvement in view of environmental hygiene.

NOTATION

Figure 1:
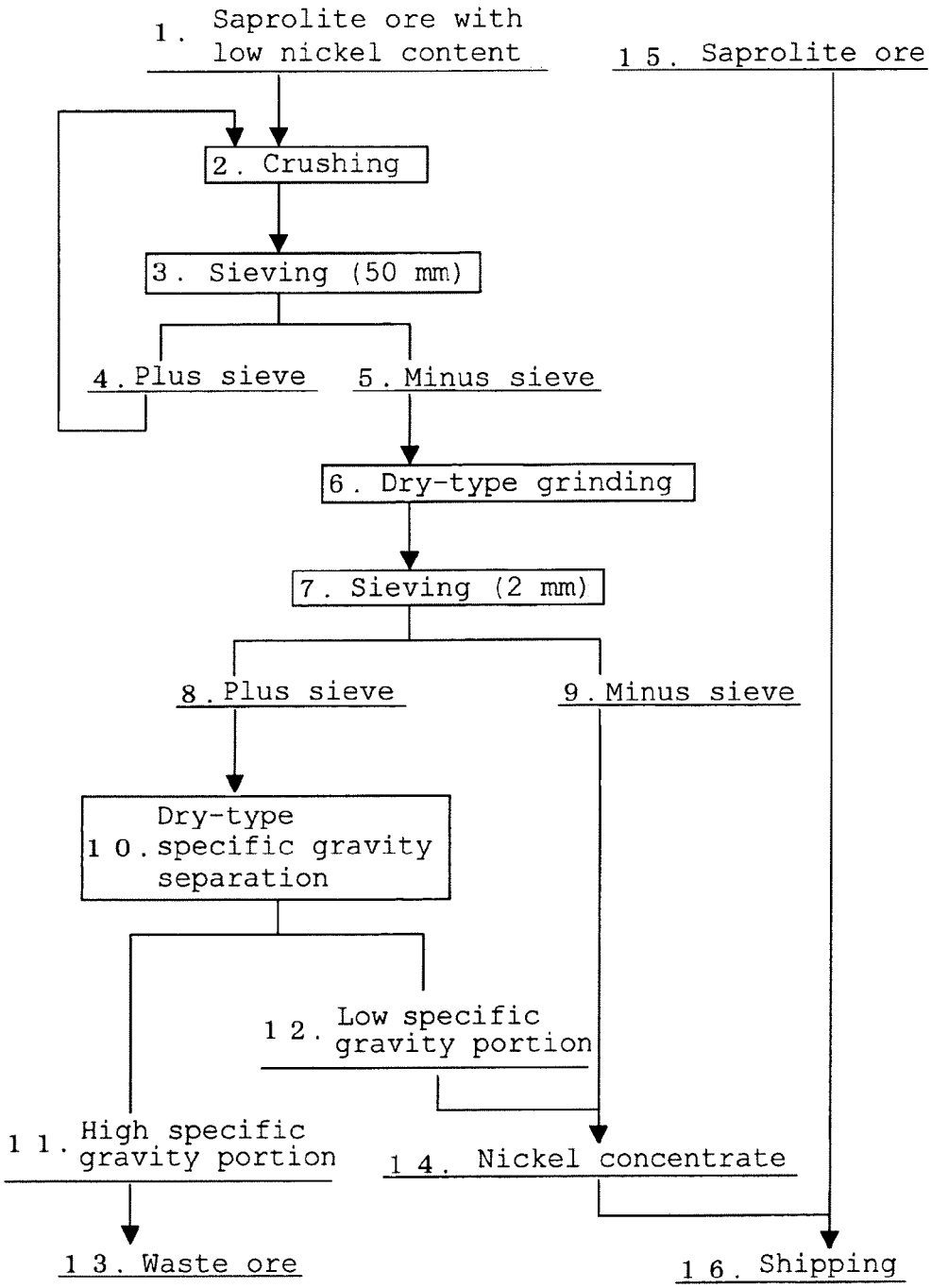
FIG. 1 is a drawing showing one example (the first embodiment) of a flow of the method for nickel concentration processing of a saprolite ore, of the present invention.

1 Saprolite ore with low nickel content
2 Crushing
3 Sieving (50 mm)
4 Plus sieve in sieving (50 mm)
5 Minus sieve in sieving (50 mm)
6 Dry-type grinding
7 Sieving (2 mm)
8 Plus sieve in sieving (2 mm)
9 Minus sieve in sieving (2 mm)
10 Dry-type specific gravity separation
11 High specific gravity portion
12 Low specific gravity portion
13 Waste ore
14 Nickel concentrated portion
15 Saprolite ore
16 Shipping
17 Crushing, drying and dry-type grinding
18 Sieving (5 mm)
19 Plus sieve in sieving (5 mm)
20 Minus sieve in sieving (5 mm)
21 Air-flow classification
22 Fine particle portion
23 Rough particle portion

DETAILED DESCRIPTION OF THE INVENTION

Explanation will be given below in detail on the method for nickel concentration processing of a saprolite ore, of the present invention.

The first embodiment of the method for nickel concentration processing of the saprolite ore according to the present invention, is characterized by including the steps of the following (1) to (4).

(1) a saprolite ore is subjected to crushing processing to adjust the ore particle size to a size passing a sieve with an mesh opening of 50 mm.
(2) a crushed ore obtained in the step of the above (1) is subjected to dry-type attrition processing of the surface layer part by attrition.
(3) a ground ore obtained in the step of the above (2) is subjected to dry-type classification processing at a classification point to be selected from 0.5 to 2.0 mm, and then an ore portion having a particle size of equal to or smaller than said classification point is subjected to the another dry classification to recover fine particles as a nickel concentrate.
(4) an ore portion having a particle size over the classification point, obtained in the step of the above (3), is subjected to dry-type specific gravity separation processing, and then an ore portion having a specific gravity of equal to or smaller than 2.0, is recovered as a nickel concentrate.

Still more, if necessary, the step of the following (5) may be contained:

(5) an ore portion having a particle size of equal to or smaller than the classification point, obtained in the step of the above (3), and an ore portion having a specific gravity of equal to or smaller than 2.0, obtained in the step of the above (4), are mixed to a saprolite ore for a raw material of ferronickel smelting having a free water In the above method (the first embodiment), it is important that an ore after crushing processing obtained in the step of the above (1) is subjected to dry-type attrition processing of the surface layer part, then it is subjected to dry-type classification processing at a predetermined classification point to recover an ore portion having a particle size of equal to or smaller than that classification point, as a nickel concentrate, and still more an ore portion having a particle size over the classification point is subjected to dry-type specific gravity separation processing at a predetermined specific gravity to recover an ore portion having a specific gravity of equal to or smaller than that specific gravity, as a nickel concentrate.

First, explanation will be given on action effect of dry-type specific gravity separation processing. That is, investigation results on present states of nickel in various saprolite ores are shown in Table 1. Table 1 shows investigation results of nickel concentration states (weight distribution rate, increased content (variation difference of nickel content (% by mass), and nickel distribution rate) by each portion of particle size and specific gravity, by measurement of particle size (sieve: 150, 100, 75, 50, 25, 9.5, 1.7, 1.0 and 0.5 mm) and specific gravity (heavy liquid: 2.6, 2.4, 2.2 and 2.0), by sampling 33 saprolite ore samples in total, having low nickel content of equal to or lower than 2.0%, from nickel ores in operation. It should be noted that specific gravity separation was carried out by using a solution of sodium polytangstenate, as a heavy liquid, and separation after standing still for 30 minutes. Table 1 shows results of weighted average on products obtained by the tests.

TABLE 1

| Particle size (mm) | Specific gravity ≧2.6 | 2.4~2.6 | 2.2~2.4 | 2.0~2.2 | ≦2.0 | Not-separated |
|---|---|---|---|---|---|---|
| | Weight distribution rate (%) | | | | | |
| +150 | — | — | — | — | — | 1.5 |
| +100 | 0.0 | 0.0 | 0.8 | 1.1 | 1.2 | — |
| +75 | 0.3 | 0.0 | 1.4 | 1.2 | 4.9 | — |
| +50 | 0.1 | 0.2 | 0.7 | 3.1 | 6.2 | — |
| +25 | 0.1 | 1.4 | 2.9 | 3.3 | 0.6 | — |
| +9.5 | 0.3 | 3.5 | 3.7 | 1.1 | 0.2 | — |
| +1.7 | 0.8 | 6.7 | 2.3 | 0.4 | 0.1 | — |
| +1.0 | 0.3 | 1.6 | 0.3 | 0.0 | 0.0 | — |
| +0.5 | 0.3 | 2.0 | 0.3 | 0.0 | 0.0 | — |
| −0.5 | — | — | — | — | — | 43.1 |
| Slime | — | — | — | — | — | 1.6 |
| | Increased content | | | | | |
| +150 | — | — | — | — | — | 0.57 |
| +100 | 0.00 | 0.00 | −0.33 | 0.47 | 0.10 | — |
| +75 | −1.43 | 0.00 | −0.4 | 0.06 | 0.16 | — |
| +50 | −0.72 | −0.87 | −0.48 | 0.20 | 0.33 | — |
| +25 | −0.69 | −0.50 | −0.10 | 0.03 | 0.93 | — |
| +9.5 | −0.73 | −0.42 | −0.13 | 0.01 | −0.17 | — |
| +1.7 | −1.05 | −0.31 | −0.16 | 0.09 | 0.09 | — |
| +1.0 | −1.00 | −0.34 | 0.04 | 0.33 | 0.20 | — |
| +0.5 | −0.85 | −0.32 | 0.03 | 0.43 | 0.11 | — |
| −0.5 | — | — | — | — | — | 0.10 |
| slime | — | — | — | — | — | 0.16 |
| | Nickel distribution rate (%) | | | | | |
| +150 | — | — | — | — | — | 1.6 |
| +100 | 0.0 | 0.0 | 0.5 | 1.3 | 1.3 | — |
| +75 | 0.1 | 0.0 | 1.2 | 1.2 | 5.2 | — |
| +50 | 0.1 | 0.1 | 0.5 | 3.3 | 7.1 | — |
| +25 | 0.1 | 1.0 | 2.7 | 3.3 | 0.8 | — |
| +9.5 | 0.2 | 2.8 | 3.5 | 1.2 | 0.2 | — |
| +1.7 | 0.3 | 5.6 | 2.2 | 0.5 | 0.1 | — |
| +1.0 | 0.1 | 1.3 | 0.3 | 0.0 | 0.0 | — |
| +0.5 | 0.2 | 1.7 | 0.3 | 0.1 | 0.0 | — |
| −0.5 | — | — | — | — | — | 46.3 |
| slime | — | — | — | — | — | 1.8 |

From Table 1, it is found that nickel is concentrated in (1) rough particles with low specific gravity, that is, having a particle size width of 25 to 75 mm, and a specific gravity of equal to or smaller than 2.0, and (2) fine particles with middle specific gravity, that is, having a particle size width of equal to or smaller than 1.7 mm, and a specific gravity of 2.0 to 2.4. That is, nickel content of a high specific gravity part of equal to or larger than 2.4 is low, and by removal of this part, ore content can be increased. In particular, it is found that nickel is concentrated, in the rough particle portion, in a range having smaller specific gravity, while in the fine particle portion, in a specific gravity range of 2.0 to 2.2. That is, it was shown that by separation and removal of the ore portion having rough particle size and high specific gravity range, ore content of an ore can be increased.

Figure 2:
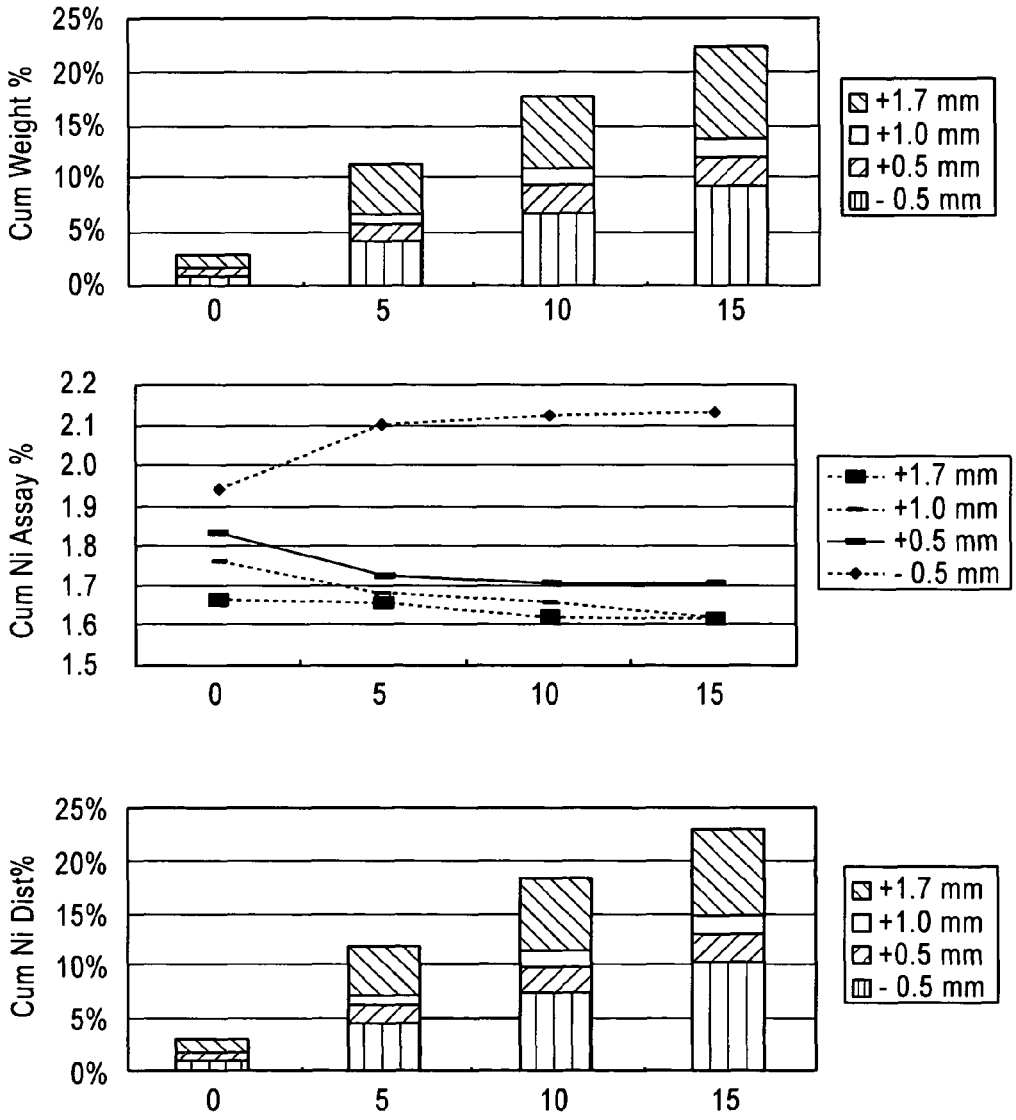
FIG. 2 is a drawing showing a concentrated state of nickel by grinding processing and a crushing processing test. (a) shows the case ground-processed by cement mixer, and (b) shows the case crushed by jaw crusher
Figure 2:
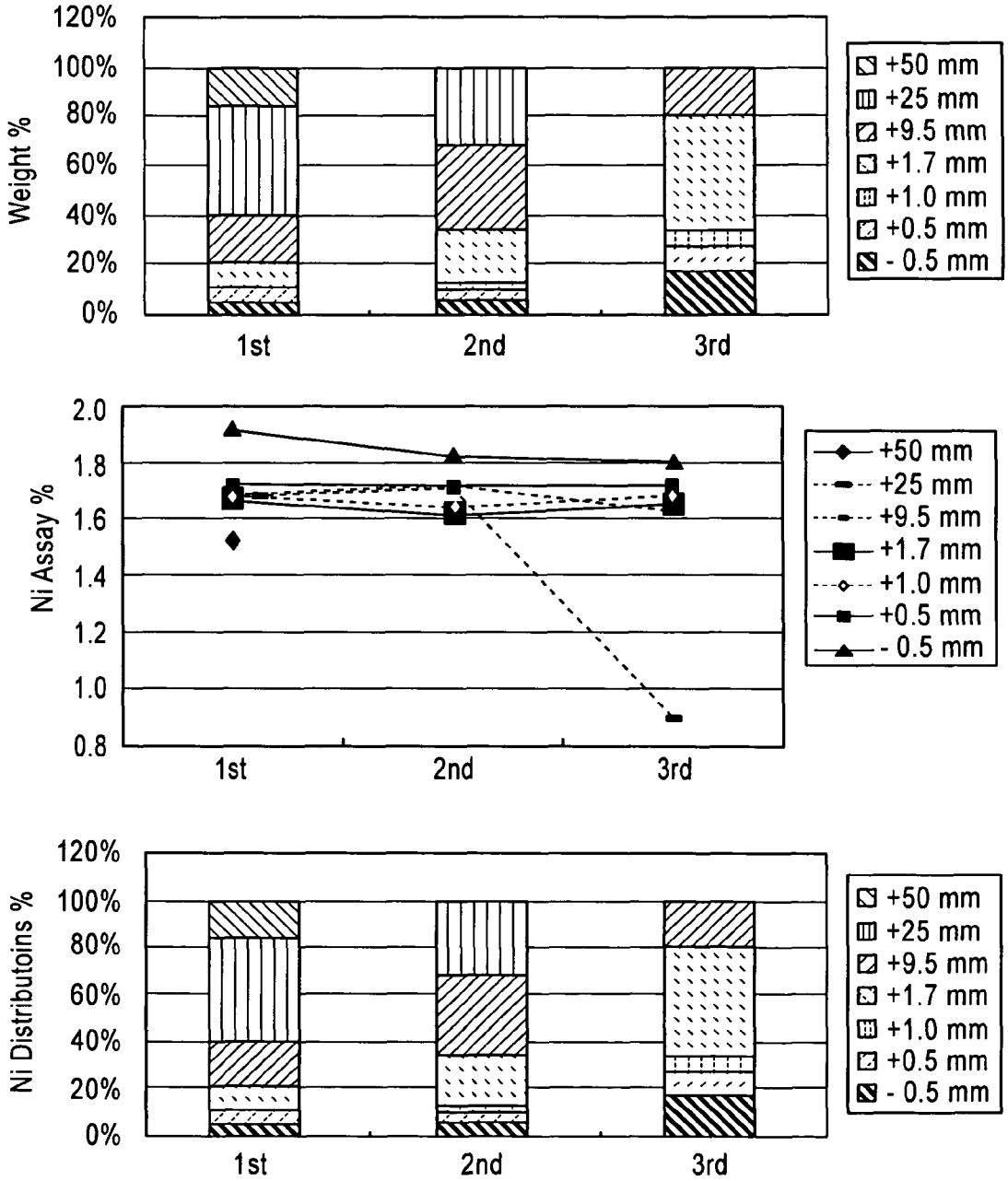

Next, explanation will be given on action effect of dry-type grinding processing of a surface layer part, by attrition. That is, it is considered that, in a saprolite ore, a nickel ore is absorbed at goethite or the like mainly in a disseminated state, and is concentrated at the surface layer of the ore obtained by crushing to a predetermined size. Therefore, dry-type grinding processing by attrition for peeling off the ore surface layer after crushing is considered effective as a concentration method. FIG. 2 compares whether there is difference in nickel concentration between the case (b) of normal crushing and the case (a) of grinding processing. Here, in the above case (a), an ore of the Moneo mine was crushed with a handheld hammer, and then sieved with a 9.5 mm sieve to determine weight distribution rate, nickel content, and nickel distribution rate, by each particle size classification of minus sieve at that time, and then a portion of plus sieve was subjected to attrition processing by a cement mixer, three times in total for each 5 minutes, and sieving with a 9.5 mm sieve each time to determine cumulative weight distribution rate, cumulative nickel content, and cumulative nickel distribution rate, by each particle size of minus sieve at that time. In addition, in the above case (b), an ore of the Moneo mine was crushed with a handheld hammer, and then crushed with a three-stage jaw-crusher, and weight distribution rate, nickel content, and nickel distribution rate are shown by each particle size portion by sieving at each stage. From FIG. 2, it is found that in the case (a) for attrition processing with a cement mixer, nickel concentration is observed, while in the case (b) for mainly impact and compression crushing with the jaw-crusher, nickel concentration is little observed, and thus it is understood that attrition effect is very strong.

From the above, because nickel concentration is observed in a saprolite ore, on (a) rough particles with low specific gravity, that is, having a particle size width of 25 to 75 mm, and a specific gravity of equal to or smaller than 2.0, (b) fine particles with middle specific gravity, that is, having a particle size width of equal to or smaller than 1.7 mm, and a specific gravity of 2.0 to 2.4 and (c) particles with a particle size of equal to or smaller than 0.5 mm obtained by these attrition, as for a method for concentration to a nickel content of equal to or higher than 2.0% by mass, which can be processed in ferronickel smelting process of conventional technology, by using, as a raw material, a saprolite ore with low nickel content of equal to higher than 1.8% by mass and below 2.0% by mass, and by concentrating the nickel by the dry-type step including attrition and classification, and still more specific gravity separation, it is important to efficiently separate these particles and particle portions having nickel concentrated.

Explanation will be given on one example of the method for nickel concentration processing of the above saprolite ore (the first embodiment), with reference to a drawing. FIG. 1 is one example of a flow of the method for nickel concentration processing of a saprolite ore according to the present invention.

In FIG. 1, first, a saprolite ore 1 having low nickel content is divided to a minus sieve 5 of ore particle size of equal to or smaller than 50 mm and a plus sieve 4, by crushing 2 and sieving (50 mm) 3. The plus sieve 4 is crushed to an ore particle size of equal to or smaller than 50 mm, with a closed-loop crushing system. Then, the minus sieve 5 portion is subjected to dry-type attrition 6, and is then divided by sieving (2 mm) 7 at a classification point of 2 mm. The obtained minus sieve 9 portion is recovered as a nickel concentrate 14. In addition, the plus sieve 8 portion is separated to a portion 11 having a high specific gravity of equal to or larger than 2.0, and a portion 12 having low specific gravity, by dry-type specific gravity separation 10. The portion 11 having high specific gravity becomes a waste ore 13. The portion 12 having low specific gravity is recovered as a nickel concentrate 14.

Still more, if necessary, the obtained nickel concentrate 14 is mixed with a saprolite ore 15 having high nickel content, for shipping 16.

The saprolite ore to be used in the above method (the first embodiment) is not especially limited, however, among various saprolite ores, a saprolite ore having low nickel content is suitable, that is, one having high content of calcium or sodium, relatively low serpentinization of ultramafic rocks, and a nickel content of equal to or lower than 2.3% by mass, in particular, a nickel content of 1.8 to 2.3% by mass. It is natural that also a saprolite ore having a nickel content of over 2.3% by mass can be processed, however, because it can be processed by conventional ferronickel smelting technology, it can be selected, as appropriate, depending on balance between cost of the above method and smelting cost by increase in nickel content.

The step of the above (1) is a size reduction process to make a feed size of a stirring type dryer, however, mined saprolite ore is usually first classified with using the Grizzly with a mesh opening of 150 mm. An oversize is disposed as muck because of having the content of equal to or lower than a target level, while an undersize portion is handled as a product, and nickel is concentrated at the surface layer thereof. The underflow of grizzly can be fed as a feed of a stirring-type dryer directly for drying and attrition process. On the other hand, all mined saprolite ore can be fed to the dry type aerogenous mill without a grizzly.

The step of the above (2) is a step for subjecting a crushed ore obtained in the step of the above (1) to dry-type attrition processing of the surface layer part. Here, in a dry-type method, attrition processing is performed to peel off the surface layer part of particles of saprolite ore, with using a cement mixer or the like. It should be noted that the surface layer part of particles of saprolite ore has high void ratio, and is very easily peeled off, therefore attrition is performed by attrition of saprolite ore particles themselves, without requiring a grinding media or the like. Here, in the case of insufficient attrition effect, separation is performed insufficiently between a portion with high nickel concentration and a low content portion, and thus nickel recovery rate is decreased, on the other hand, too strong attrition results in the attrition even for a portion having no nickel concentration, which makes separation difficult at the subsequent steps, therefore, it is necessary to confirm suitable operation condition in operation.

Attrition is usually performed by stirring of high density pulp in the wet process. In the dry process, the attached water is vaporised through the porous surface of ore, so the surface is fractuated with a kind of heat shock, therefore, attrition with a dry process can be achieved easily in the drying process.

The step of the above (3) is a step for subjecting a attrition in the step of the above (2) to dry-type classification processing at a classification point to be selected from 0.5 to 2.0 mm, and then for recovering an ore portion having a particle size of equal to or smaller than the classification point, as a nickel concentrate. Here, in particles having a particle size over 2.0 mm, there are remained in a mixed state, particles of a portion having no nickel concentration, and particles of a portion having nickel concentration, therefore nickel concentration is insufficient. In addition, as described above, in particles with a particle size of equal to or smaller than 0.5 mm obtained by performing the attrition, nickel is concentrated. It should be noted that a classification point is selected as the most suitable condition depending on an ore.

The step of the above (4) is a step for subjecting an ore portion having a particle size over the classification point obtained in the step of the above (3), to dry-type specific gravity separation processing, and then for recovering an ore portion having a specific gravity of equal to or smaller than 2.0, as a nickel concentrate. That is, in an ore portion with a particle size over the classification point obtained in the step of the above (3), nickel is concentrated in particles having high void ratio, and apparent specific gravity thereof is as small as equal to or smaller than 2.0. On the other hand, because nickel adsorbed at the surface layer is already removed by attrition, particles with a specific gravity of over 2.0 have a low nickel concentration rate. Here because particles with a specific gravity of over 2.0 have no nickel concentration, they are subjected to waste processing, as muck (tailings).

As an apparatus to be used in the step of the above (4), a dry-type specific gravity separation apparatus such as a dry-type fluidized bed specific gravity separation apparatus, an air table, a dry-type jig is used preferably. It should be noted that a rough particle portion obtained by attrition has relatively large size and solar drying is also possible, therefore adoption of a wet-type specific gravity separation apparatus, such as a usual jig or heavy liquid ore selection is also possible.

However, in using the dry-type fluidized bed specific gravity separation apparatus as the dry-type specific gravity separation apparatus, a specific gravity point of separation becomes lower, as compared with a wet-type specific gravity separation, because of presence of voids in the rough particles, and as the specific gravity point of separation, a specific gravity of 1.6 to 2.0 is used.

The step of the above (5) is a step for mixing an ore portion having a particle size of equal to or smaller than the classification point obtained in the step of the above (3), and an ore portion having a specific gravity of equal to or smaller than 2.0 obtained in the step of the above (4), to a saprolite ore for a raw material of ferronickel smelting having a free water. That is, a saprolite ore originally contains moisture in an amount of about 20 to 35%, and when moisture is contained, viscosity is high and sieving is difficult, on the other hand, drying of the ore generates powder dust, which generates not only nickel loss contained in fine particles but also a big problem in view of work environment in handling. Therefore, water spraying to suppress powder dust raises a problem of inhibiting an object of decreasing transportation cost and drying cost in smelting, by intentional drying to decrease moisture content. In order to solve this problem, such an operation system can be performed that an ore of the above nickel concentrated portion is mixed to a saprolite ore having a nickel content of equal to or higher than 2.3% by mass, which is not required to subject to the method of the present invention, to decrease powder dust owing to moisture in the saprolite ore.

As described above, by performing the steps of the above (1) to (4) sequentially, concentration is possible to a nickel content of equal to or higher than 2.3% by mass, which can be processed by a ferronickel smelting process of a conventional technology, by using a saprolite ore having a low nickel content of 1.8 to 2.3% by mass, as a raw material, and by concentration of nickel in attrition and classification, and still more a dry-type step including specific gravity separation. In this way, a process is attained, which is capable of reducing transportation cost and smelting cost at the same time, and it is also an environmentally benign process with low environmental load, not requiring a tailing dam at a mine site, and no water processing.

Still more, according to the step (5), by transportation after mixing with a saprolite ore having high nickel content, which does not require the method for nickel concentration processing, of the present invention, an operation embodiment can be provided, which is capable of suppressing powder dust generation, which becomes a problem in a dry-type system, enhancing the handling performance and also attaining improvement in view of environmental hygiene.

A second embodiment of the method for nickel concentration processing of the saprolite ore, of the present invention, is characterized by including the step of the following (1') instead of the steps of the above (1) and (2).

(1') a saprolite ore is subjected to crushing, drying and dry-type attrition processing by using a stirring-type dryer to perform crushing processing, drying processing and dry-type attrition processing at the same time, to adjust the ore particle size to a size passing a sieve with an mesh opening of 50 mm.

In the above method (the second embodiment), it is important that a saprolite ore, for example, an ore classified by using the Grizzly with a mesh opening of 150 mm, is subjected to crushing, drying and dry-type attrition processing by using a stirring-type dryer, which is capable of providing attrition effect by stirring under drying, to adjust the ore particle size to a size passing a sieve with an mesh opening of 50 mm. In this way, the step of the above (1) and the step of (2) can be omitted.

That is, drying of a saprolite ore with hot air or direct fire induces thermal crushing, caused by abrupt expansion of moisture contained in pore clearance, and makes the ore surface layer very brittle. Therefore, in drying of a saprolite ore, with using a stirring-type drier for drying a supplied substance under stirring and heating, crushing, drying and dry-type attrition may be performed at the same time.

In the above method (the second embodiment), the step of (3) and the step of (4) used in the first embodiment, may be carried out subsequent to the step of (1'), however, it is preferable that the steps of the following (2') to (4') are performed subsequent to the step of (1').

(2') a ground ore obtained in the step of the above (1'), is subjected to dry-type classification processing at a classification point to be selected from 2 to 5 mm.

(3') an ore portion having a particle size of equal to or smaller than the classification point obtained in the step of the above (2'), is subjected to dry-type classification processing at a classification point to be selected from 0.01 to 2.0 mm, and then an ore portion having a particle size of equal to or smaller than the classification point, is recovered as a nickel concentrate.

(4') an ore portion having a particle size over the classification point obtained in the step of the above (2'), is subjected to dry-type specific gravity separation processing, and then an ore portion having a specific gravity of equal to or smaller than 2.0, is recovered as a nickel concentrate.

A saprolite ore to be used in the above method (the second embodiment) is not especially limited, however, a similar one as in the above method (the first embodiment) is used. Here, a undersize portion of the Grizzly is used as a target ore, and particle size of this ore is adjusted so as to be a size passing a sieve with a mesh opening of 50 mm. This plus sieve is crushed to a particle size of ore of equal to or smaller than 50 mm, by a closed circuit crushing system.

The step of the above (1') is a step for subjecting a saprolite ore to crushing, drying and dry-type attrition processing by using a stirring-type dryer to perform all three processes at the same time, to adjust the ore particle size to a size passing a sieve with an mesh opening of 50 mm.

In the above processing, such conditions of drying temperature, residence time and stirring state (rotation speed and shape or the like of a stirring apparatus) are selected, so that crushing to a desired size distribution and sufficient attrition effect can be obtained at the same time. It should be noted that, in the case of insufficient attrition effect, separation is performed insufficiently between a portion with high nickel concentration and a low content portion, and thus nickel recovery rate is decreased, on the other hand, in the case of too strong attrition, a portion having no nickel concentration is also crushed finely, which makes separation at the subsequent steps difficult, therefore, it is necessary to confirm suitable operation condition in operation.

A stirring-type dryer to be used in the step of the above (1') is not especially limited, and a drying furnace equipped with a stirring blade, which is capable of strong stirring while drying an ore, a heating-type peripheral discharging-type autogenous mill or a heating-type peripheral discharging-type semi-autogenous mill is used.

Here, drying temperature is not especially limited, and temperature capable of drying the above saprolite ore is used, however, 600 to 1200° C. is preferable. In this way, sufficient attrition effect is obtained, because thermal crushing is performed by abrupt expansion of moisture contained in voids of the saprolite ore, which makes the ore surface layer very brittle.

The step of the above (2') is a step for subjecting a ground ore obtained in the step of the above (1'), to dry-type classification processing at a classification point to be selected from 2 to 5 mm. Here, in particles having a particle size over 2.0 mm, there are remained particles of a portion having no nickel concentration and particles of a portion having nickel concentration, in a mixed state, therefore, nickel concentration is insufficient. In addition, as described above, in particles with a particle size of equal to or smaller than 2 mm, obtained by performing of attrition, nickel is concentrated to a certain degree. It should be noted that a classification point is selected as the most suitable condition depending on an ore.

Dry-type classification processing to be used in the step of the above (2') is not especially limited, however, a sieving method is used.

The step of the above (3') is a step for subjecting an ore portion having a particle size of equal to or smaller than the classification point, obtained in the step of the above (2'), to dry-type classification processing at a classification point to be selected from 0.01 to 2.0 mm, and then for recovering an ore portion having a particle size of equal to or smaller than the classification point, as a nickel concentrate.

Here, in particles having a particle size over 2.0 mm, there are many particles of a portion having no nickel concentration, therefore, nickel concentration is insufficient. In addition, as described above, in particles with a particle size of equal to or smaller than 0.01 mm, obtained by performing the attrition, nickel is concentrated. It should be noted that a classification point is selected as the most suitable condition depending on an ore.

Dry-type classification processing to be used in the step of the above (3') is not especially limited, however, an air-flow classification method, which is effective in classification of fine powder, is used.

The step of the above (4') is a step for subjecting an ore portion having a particle size over the classification point, obtained in the step of the above (2'), to dry-type specific gravity separation processing, and then for recovering an ore portion having a specific gravity of equal to or smaller than 2.0, as a nickel concentrate. That is, in an ore portion with a particle size over the classification point, obtained in the step of the above (2'), nickel is concentrated in particles having high void ratio, and apparent specific gravity thereof is as small as equal to or smaller than 2.0, in addition, because nickel adsorbed at the surface layer is already removed by attrition, particles with a specific gravity of over 2.0 have a low nickel concentration rate. Here because particles with a specific gravity of over 2.0 have no nickel concentration, they are subjected to waste processing, as muck (tailings).

As an apparatus to be used in the step of the above (4'), a dry-type specific gravity separation apparatus such as a dry-type fluidized bed specific gravity separation apparatus, an air table, a dry-type jig is used preferably. It should be noted that a rough particle portion obtained by attrition has relatively large size and solar drying is also possible, therefore, adoption of a wet-type specific gravity separation apparatus such as a usual jig or heavy liquid ore selection is also possible.

However, in using the dry-type fluidized bed specific gravity separation apparatus as the dry-type specific gravity separation apparatus, a specific gravity point of separation becomes lower, as compared with a wet-type specific gravity separation, because of presence of voids in the rough particles, and as the specific gravity point of separation, a specific gravity of 1.6 to 2.0 is used.

Figure 3:
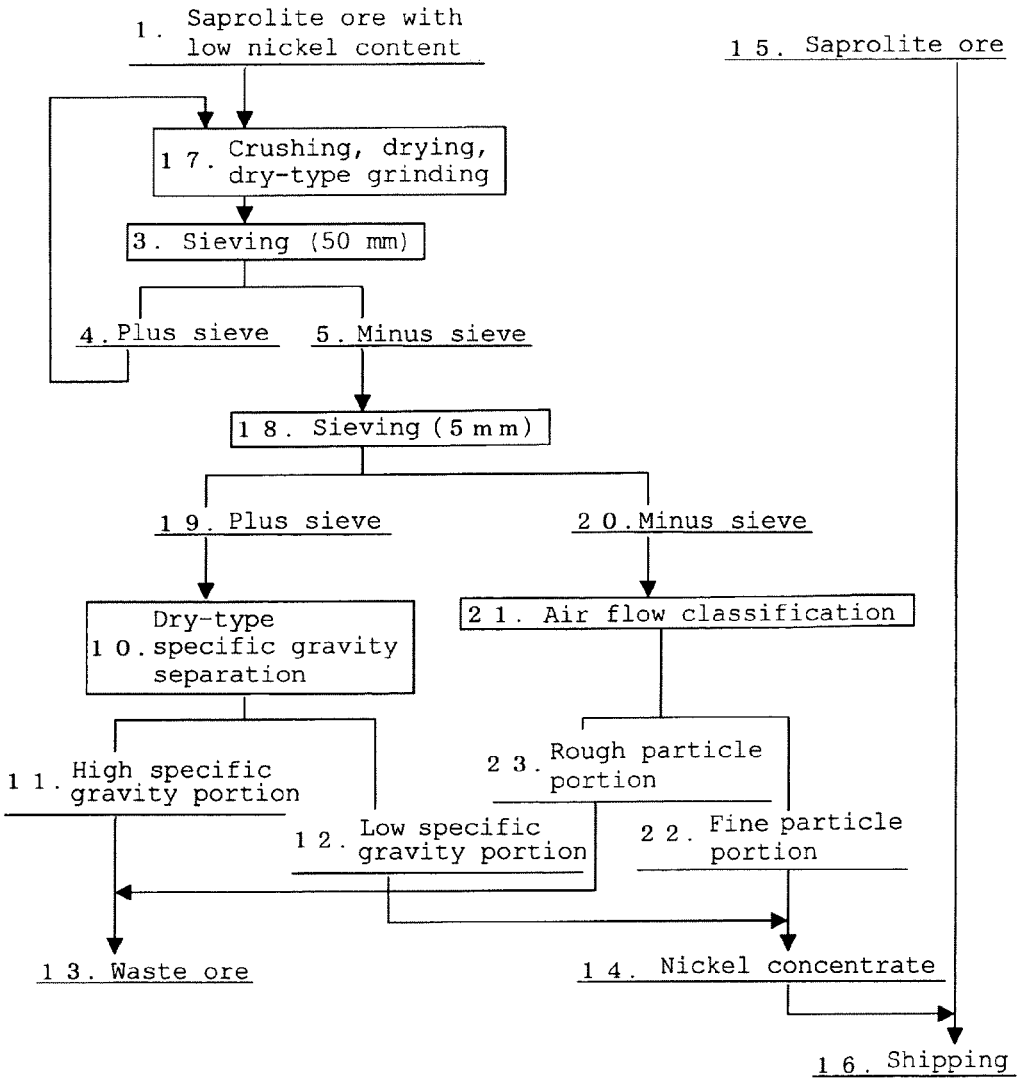
FIG. 3 is a drawing showing one example (the second embodiment) of a flow of the method for nickel concentration processing of a saprolite ore, of the present invention.

Explanation will be given on one example of the above method (the second embodiment), with reference to a drawing. FIG. 3 is one example of a flow of the method for nickel concentration processing of a saprolite ore, of the present invention.

In FIG. 3, first, a saprolite ore 1 having low nickel content is divided to a minus sieve 5 with ore particle size of equal to or smaller than 50 mm, and a plus sieve 4, by crushing, drying and dry-type attrition 17 and sieving (50 mm) 3. The plus sieve 4 is crushed to an ore particle size of equal to or smaller than 50 mm, by a closed circuit crushing system. Then, the minus sieve portion 5 is divided by sieving (5 mm) 18 at a classification point of 5 mm. The plus sieve 19 portion obtained here is separated to a high specific gravity portion 11 of equal to or larger than 2.0, and a low specific gravity portion 12, by dry-type specific gravity separation 10. The high specific gravity portion 11 is handled as a waste ore 13. The low specific gravity portion 12 is recovered as a nickel concentrate 14. In addition, a minus sieve 20 portion is divided by air-flow classification 21 again. The fine particle portion 22 obtained here is recovered as a nickel concentrate 14. In addition, the rough particle portion 23 is handled as a waste ore 13.

Still more, if necessary, the obtained nickel concentrate 14 is mixed with a saprolite ore 15 having high nickel content, for shipping 16.

As described above, by performing the steps of the above (1') to (4') sequentially, concentration is possible to a nickel content of equal to or higher than 2.3% by mass, which can be processed by a ferronickel smelting process of a conventional technology, by using a saprolite ore having a low nickel content of 1.8 to 2.3% by mass, as a raw material, and by concentration of nickel in grinding and classification, and still more a dry-type step including specific gravity separation. In this way, a process is attained, which is capable of reducing transportation cost and smelting cost at the same time, and it is also an environmentally benign process with low environmental load, not requiring a tailing dam at a mine site, and no water processing.

Still more, according to the step (5'), by transportation after mixing with a saprolite ore having high nickel content, which does not require the method for nickel concentration processing, of the present invention, an operation embodiment can be provided, which is capable of suppressing powder dust generation, which becomes a problem in a dry-type system, enhancing the handling performance and also attaining improvement in view of environmental hygiene.

EXAMPLES

Explanation will be given below further in detail on the present invention with reference to Examples of the present invention, however, the present invention should not be limited to these Examples. It should be noted that analysis of nickel, used in Examples, is carried out by an ICP emission spectrometry.

Example 1

Nickel concentration processing of a saprolite ore was carried out according to a flow-sheet of FIG. 1.

First, mined saprolite ores A to I were crushed to a size of equal to or smaller than 50 mm with a jaw-crusher to enhance handling performance in the subsequent steps. Next, attrition was carried out with a cement mixer, on the ore crushed to a size of equal to or smaller than 50 mm, after drying, and subsequently dry-type sieving was carried out at a classification point of 2.0 mm. The rough particles thus classified were sent to dry-type specific gravity separation, and separated at a specific gravity of 2.0 with using a dry-type fluidized bed specific gravity separation apparatus. It should be noted that the specific gravity separation was carried out by each particle size, however, sufficient separation was impossible for the particle size with a range of 2.0 to 5.0 mm, due to interaction with a medium forming the fluidized bed.

Here, a heavier ore portion with a specific gravity of larger than 2.0 and with low nickel concentration degree is eliminated as muck (tailings). In addition, an ore portion with a specific gravity of 1.6 to 2.0 was recovered as a nickel concentrate together with a fine size portion having a specific gravity of equal to or smaller than 2.0 mm, classified in the preceding step. Then, nickel content of the nickel concentrate, a raw material ore and a muck obtained in this step, and weight distribution rate of nickel concentrate, together with nickel recovery rate were determined. The results are shown in Table 2.

TABLE 2

| | Ni content (mass %) | | | Concentrate | Ni recovery rate |
|---|---|---|---|---|---|
| Ore | Raw ore | Concentrate | Muck | Wt. ratio (%) | (%) |
| A | 1.82 | 2.00 | 1.61 | 52.8 | 58.1 |
| B | 1.74 | 2.01 | 1.52 | 44.1 | 51.1 |
| C | 2.06 | 2.27 | 1.73 | 60.1 | 66.4 |
| D | 1.79 | 2.12 | 1.51 | 45.5 | 53.9 |
| E | 1.53 | 1.87 | 1.31 | 39.6 | 48.2 |
| F | 1.43 | 1.70 | 1.21 | 45.9 | 54.3 |
| G | 2.41 | 3.25 | 2.01 | 32.1 | 43.3 |

TABLE 2-continued

| | Ni content (mass %) | | | Concentrate | Ni recovery rate |
|---|---|---|---|---|---|
| Ore | Raw ore | Concentrate | Muck | Wt. ratio (%) | (%) |
| H | 1.95 | 2.16 | 1.29 | 75.5 | 83.7 |
| I | 1.75 | 2.07 | 1.21 | 61.3 | 72.6 |

From Table 2, it is found that the nickel concentrate of each ore has increased the nickel content by 10 to 30%, compared with that of the raw ore, and as for a saprolite ore with low nickel content, nickel recovery rate is about 60%.

Example 2

Nickel concentration processing of a saprolite ore was carried out according to a flow-sheet of FIG. 3.

First, saprolite ores J and K classified using the Grizzly with a mesh opening of 150 mm, were subjected to dry-type sieving at a classification point of 50 mm, after drying under conditions of a drying temperature of 85° C., a residence time of 20 minutes, and a stirring rotation speed of 175 rpm, with using a dryer equipped with a stirrer (manufactured by NHI Co., Ltd. "Shin-Nihonkai Heavy Industry Co., Ltd.") to prepare an ore with a particle size of equal to or smaller than 50 mm.

Particle size distribution of the obtained ore is shown in Table 3. It should be noted that measurement of the particle size distribution was carried out by a dry-type Ro-Tap method, and D90 to D10 in this Table represent each particle size of 90% to 10% of cumulative mass distribution rate.

Next, dry-type sieving was carried out at a classification point of 5.0 mm. Rough particulates classified by the dry-type sieving were sent to dry-type specific gravity separation to separate at a specific gravity of 2.0, with using a dry-type fluidized bed specific gravity separation apparatus. It should be noted that, an ore portion having a specific gravity of less than 1.6 was impossible to separate due to scattering. Here, an ore portion having a specific gravity of larger than 2.0 with low nickel concentration degree was eliminated as a muck (tailings). In addition, an ore portion having a specific gravity of 1.6 to 2.0 was recovered as a nickel concentrate.

In addition, fine particulates classified with a dry-type sieve were further classified with an air-flow classifier at a classification point of 0.75 mm.

Figure 4:
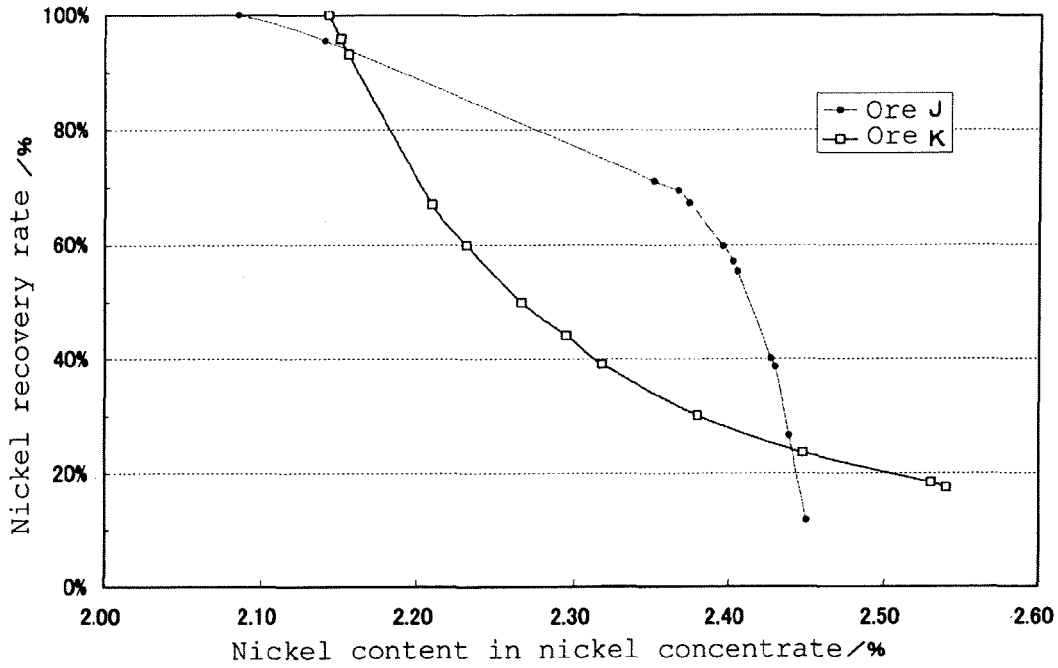
FIG. 4 is a drawing showing relation between nickel content and nickel recovery rate, in a nickel concentrate, in Example 2.

Rough particles separated with the air-flow classifier were eliminated as a muck (tailings). In addition, fine particles separated with the air-flow classifier were recovered as a nickel concentrate. Then, nickel content of the nickel concentrate, a raw material ore and a muck obtained in this step, and weight distribution rate of nickel concentrate, together with nickel recovery rate were determined. The results are shown in Table 4. In addition, FIG. 4 shows relation between nickel content and nickel recovery rate in a nickel concentrate, in this case.

TABLE 3

| | Particle size (mm) or particle size ratio of each portion | | |
|---|---|---|---|
| | Supplied ore | Ore J | Ore K |
| D90 | 25.6 | 5.7 | 9.5 |
| D80 | 15.8 | 3.3 | 5.3 |
| D50 | 4.8 | 0.68 | 0.89 |

TABLE 3-continued

| | Particle size (mm) or particle size ratio of each portion | | |
|---|---|---|---|
| | Supplied ore | Ore J | Ore K |
| D20 | 0.91 | 0.15 | 0.07 |
| D10 | 0.25 | 0.02 | 0.03 |
| D50/D10 | 19 | 34 | 30 |
| D90/D10 | 102 | 285 | 317 |
| D80/D20 | 17 | 22 | 76 |

TABLE 4

| | Ni content (mass %) | | | Concentrate | Ni recovery rate |
|---|---|---|---|---|---|
| Ore | Raw ore | Concentrate | Muck | Wt. ratio (%) | (%) |
| J | 2.08 | 2.36 | 1.64 | 61 | 69 |
| K | 2.12 | 2.38 | 2.00 | 31 | 35 |

From Table 4 and FIG. 4, it is found that nickel content of the nickel concentrate of each ore increases relative to nickel content of a raw material ore, and the nickel concentrate having the nickel content of equal to or higher than 2.3% by mass, can be recovered in a nickel recovery rate of about 69% or 35%.

As is clear from the above, the method for nickel concentration processing of a saprolite ore, of the present invention, is capable of enhancing nickel content of a saprolite ore with low nickel content, which was not conventionally used effectively, as a raw material of ferronickel smelting due to having low nickel content, to a level to be utilized economically as a raw material of ferronickel smelting, by a low cost, simple and convenient method, as well as having low environmental load, and adoption of this method is capable of significantly increasing resource amount which is usable as a raw material of ferronickel. This method is suitable as a method for nickel concentration processing of a saprolite ore with low nickel content, to be utilized particularly in a ferronickel smelting field.

What is claimed is:

1. A method for nickel concentration processing of a saprolite ore, characterized by comprising the following steps (1) to (4):

(1) a saprolite ore is subjected to crushing processing to adjust the ore particle size to a size passing a sieve with an mesh opening of 50 mm;

(2) a crushed ore obtained in the step of the above (1) is subjected to dry-type grinding processing of the surface layer part by attrition;

(3) a ground ore obtained in the step of the above (2) is subjected to dry-type classification processing at a classification point to be selected from 0.5 to 2.0 mm, and then an ore portion having a particle size of equal to or smaller than said classification point is recovered as a nickel concentrate; and (4) an ore portion having a particle size over the classification point, obtained in the step of the above (3), is subjected to dry-type specific gravity separation processing, and then an ore portion having a specific gravity of equal to or smaller than 2.0, is recovered as a nickel concentrate.

2. The method for nickel concentration processing of a saprolite ore according to claim 1, characterized in that a crushed ore is subjected to a drying processing prior to the dry-type grinding processing, in the step of the above (2).

3. The method for nickel concentration processing of a saprolite ore according to claim 2, characterized by further comprising the following step (5):

(5) an ore portion having a particle size of equal to or smaller than the classification point, obtained in the step of the above (3), and an ore portion having a specific gravity of equal to or smaller than 2.0, obtained in the step of the above (4), are mixed to a saprolite ore for a raw material of ferronickel smelting.

4. The method for nickel concentration processing of a saprolite ore according to claim 3, characterized in that the above saprolite ore has a nickel content of 1.8 to 2.3% by mass.

5. The method for nickel concentration processing of a saprolite ore according to claim 2, characterized in that the above saprolite ore has a nickel content of 1.8 to 2.3% by mass.

6. The method for nickel concentration processing of a saprolite ore according to claim 1, characterized by further comprising the following step (5):

(5) an ore portion having a particle size of equal to or smaller than the classification point, obtained in the step of the above (3), and an ore portion having a specific gravity of equal to or smaller than 2.0, obtained in the step of the above (4), are mixed to a saprolite ore for a raw material of ferronickel smelting.

7. The method for nickel concentration processing of a saprolite ore according to claim 6, characterized in that the above saprolite ore has a nickel content of 1.8 to 2.3% by mass.

8. The method for nickel concentration processing of a saprolite ore, characterized by comprising the following steps (1'), (3) and (4):

(1') a saprolite ore is subjected to crushing, drying and dry-type grinding processing by using a stirring-type dryer to perform crushing processing, drying processing and dry-type grinding processing at the same time, to adjust the ore particle size to a size passing a sieve with an mesh opening of 50 mm;

(3) a ground ore obtained in the step of the above (1') is subjected to dry-type classification processing at a classification point to be selected from 0.5 to 2.0 mm, and then an ore portion having a particle size of equal to or smaller than said classification point is recovered as a nickel concentrate; and (4) an ore portion having a particle size over the classification point, obtained in the step of the above (3), is subjected to dry-type specific gravity separation processing, and then an ore portion having a specific gravity of equal to or smaller than 2.0, is recovered as a nickel concentrate.

9. The method for nickel concentration processing of a saprolite ore according to claim 8, characterized in that the above saprolite ore has a nickel content of 1.8 to 2.3% by mass.

10. The method for nickel concentration processing of a saprolite ore according to claim 1, characterized in that the above saprolite ore has a nickel content of 1.8 to 2.3% by mass.

11. A method for nickel concentration processing of a saprolite ore, characterized by comprising the following steps (1') to (4'):

(1') a saprolite ore is subjected to crushing, drying and dry-type grinding processing by using a stirring-type dryer to perform crushing processing, drying processing and dry-type grinding processing at the same time to adjust the ore s article size to a size passing a sieve with an mesh opening of 50 mm;

(2') a ground ore obtained in the step of the above (1') is subjected to dry-type classification processing at a classification point to be selected from 2 to 5 mm;

(3') an ore portion having a particle size of equal to or smaller than said classification point, obtained in the step of the above (2'), is subjected to dry-type classification processing at a classification point to be selected from 0.01 to 2.0 mm, and then an ore portion, having a particle size of equal to or smaller than said classification point, is recovered as a nickel concentrate; and (4') an ore portion, having a particle size over the classification point, obtained in the step of the above (2'), is subjected to dry-type specific gravity separation processing, and then an ore portion, having a specific gravity of equal to or smaller than 2.0, is recovered as a nickel concentrate.

12. The method for nickel concentration processing of a saprolite ore according to claim 11, characterized by further comprising the following step (5'):

(5') an ore portion, having a particle size of equal to or smaller than the classification point, obtained in the step of the above (3'), and an ore portion, having a specific gravity of equal to or smaller than 2.0, obtained in the step of the above (4'), are mixed to a saprolite ore for a raw material of ferronickel smelting.

13. The method for nickel concentration processing of a saprolite ore according to claim 12, characterized in that the above saprolite ore has a nickel content of 1.8 to 2.3% by mass.

14. The method for nickel concentration processing of a saprolite ore according to claim 11, characterized in that the above saprolite ore has a nickel content of 1.8 to 2.3% by mass.

* * * * *